US007837516B2

(12) United States Patent
Ko et al.

(10) Patent No.: US 7,837,516 B2
(45) Date of Patent: Nov. 23, 2010

(54) CABLE CONNECTOR ASSEMBLY WITH A UNITARY CONNECTOR MOLDED WITH ANOTHER CONNECTOR

(75) Inventors: David Ko, Fullerton, CA (US); Hou-Yu Shi, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/615,285

(22) Filed: Nov. 10, 2009

(65) Prior Publication Data

US 2010/0120294 A1 May 13, 2010

(30) Foreign Application Priority Data

Nov. 10, 2008 (CN) ..... 2008 10 305432
Nov. 10, 2008 (CN) ..... 2008 20 02697

(51) Int. Cl.
*H01R 13/502* (2006.01)

(52) U.S. Cl. ..... 439/701

(58) Field of Classification Search ..... 439/701, 439/604, 606, 736, 675, 578, 660
See application file for complete search history.

(56) References Cited

U.S. PATENT DOCUMENTS 3,757,274 A * 9/1973 Hazelhurst ..... 439/281
4,704,091 A * 11/1987 Owens et al. ..... 439/281
5,906,511 A * 5/1999 Bozzer et al. ..... 439/579
6,341,961 B1 * 1/2002 Juntwait ..... 439/63
6,380,485 B1 * 4/2002 Beaman et al. ..... 174/88 R
6,482,036 B1 * 11/2002 Broussard ..... 439/606
6,506,083 B1 * 1/2003 Bickford et al. ..... 439/736
6,616,487 B1 * 9/2003 Lai ..... 439/668
6,716,071 B2 * 4/2004 Miyazaki ..... 439/859
6,776,621 B1 * 8/2004 Dye ..... 439/63
6,916,198 B2 * 7/2005 Wu et al. ..... 439/497
6,945,817 B2 * 9/2005 Miyazaki et al. ..... 439/579
7,037,133 B2 * 5/2006 Matsuo ..... 439/606
7,070,449 B2 * 7/2006 Miyazaki ..... 439/587
7,172,453 B2 * 2/2007 Skluzacek et al. ..... 439/483
7,234,967 B2 * 6/2007 Weidner et al. ..... 439/581
7,264,506 B2 * 9/2007 Mori et al. ..... 439/606
7,341,457 B2 * 3/2008 Lagathu et al. ..... 439/8
7,351,111 B2 * 4/2008 Cheng ..... 439/638
7,377,808 B2 * 5/2008 Gentry ..... 439/578
7,484,998 B2 * 2/2009 Benham ..... 439/579
7,497,724 B1 * 3/2009 Fong et al. ..... 439/497

(Continued)

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

A cable connector assembly (200) includes an electrical connector (100), a cable (91) connected with the electrical connector and an insulated cover (92) over-molded on an electrical connection between the electrical connector and the cable. The electrical connector includes a first connector (1) and a second connector (2), each of the first connector and the second connector have a contact, a middle tube enclosing the contact and an outer tube enclosing the middle tube. A first insulated housing (70) is defined between the outer tube and the middle tube of the first connector, and a second insulated housing (80) is defined between the outer tube and the middle tube of the second connector, the first insulated housing is unitarily molded with the second insulated housing. The insulated cover comprises a pair of receiving channels (921, 922).

11 Claims, 6 Drawing Sheets

U.S. PATENT DOCUMENTS 7,507,121 B1 * 3/2009 Scea et al. ..... 439/607.41
7,614,910 B2 * 11/2009 Croteau et al. ..... 439/573
2006/0110978 A1 5/2006 Fan et al.
2010/0068945 A1 * 3/2010 Chou ..... 439/701
2010/0075544 A1 * 3/2010 Liu et al. ..... 439/701

* cited by examiner

CABLE CONNECTOR ASSEMBLY WITH A UNITARY CONNECTOR MOLDED WITH ANOTHER CONNECTOR

BACKGROUND OF THE INVENTION

1. Field of the Invention

This application claims priority to prior Chinese patent applications 200810305432.8 and 200820302697.8, the disclosure of which are incorporated herein by reference.

The present invention generally relates to a cable connector assembly, and more particularly to a cable connector assembly with an improved cover.

2. Description of Related Art

A conventional, cable connector assemblies are widely used in an electronic equipment, especially for transmitting power, and the performance of the cable connector assembly directly impacts on the entire electronic equipment whether can normally run.

U.S. Pub. No. 2006/0110978A1 published to Fan on Aug. 1, 2005 discloses a cable connector assembly, the cable connector assembly is a power connector and comprises a plurality of insulative housings, and each insulative housing has a contact received therein. Each insulative housing defines a slot and a projection located on both sides thereof, and the slot of one insulative housing is engaging with the projection of another insulative housing to make the two neighboring insulative housings conjunct with each other. However, the combination between the two insulative housings may be weak to induce the two contacts to be located on different planes, and an electrical connection between the cable connector assembly and a complementary connector may be unstable.

Correspondingly, it is desired to have a cable connector assembly with an unitary connector molded with another connector to address the problems stated above.

BRIEF SUMMARY OF THE INVENTION

Accordingly, an object of the present invention is to provide a cable connector assembly having a unitary connector molded with another connector.

In order to achieve the above-mentioned object, a cable connector assembly in accordance with the present invention comprises an electrical connector, a cable connected with the electrical connector and an insulated cover over-molded on an electrical connection between the electrical connector and the cable. The electrical connector includes a first connector and a second connector, each of the first connector and the second connector have a contact, a middle tube enclosing the contact and an outer tube enclosing the middle tube. A first insulated housing is defined between the outer tube and the middle tube of the first connector, and a second insulated housing is defined between the outer tube and the middle tube of the second connector, the first insulated housing is unitarily molded with the second insulated housing. The insulated cover comprises a pair of receiving channels.

Other objects, advantages and novel features of the invention will become more apparent from the following detailed description of the present embodiment when taken in conjunction with the accompanying drawings.

DETAILED DESCRIPTION OF THE INVENTION

Figure 1:
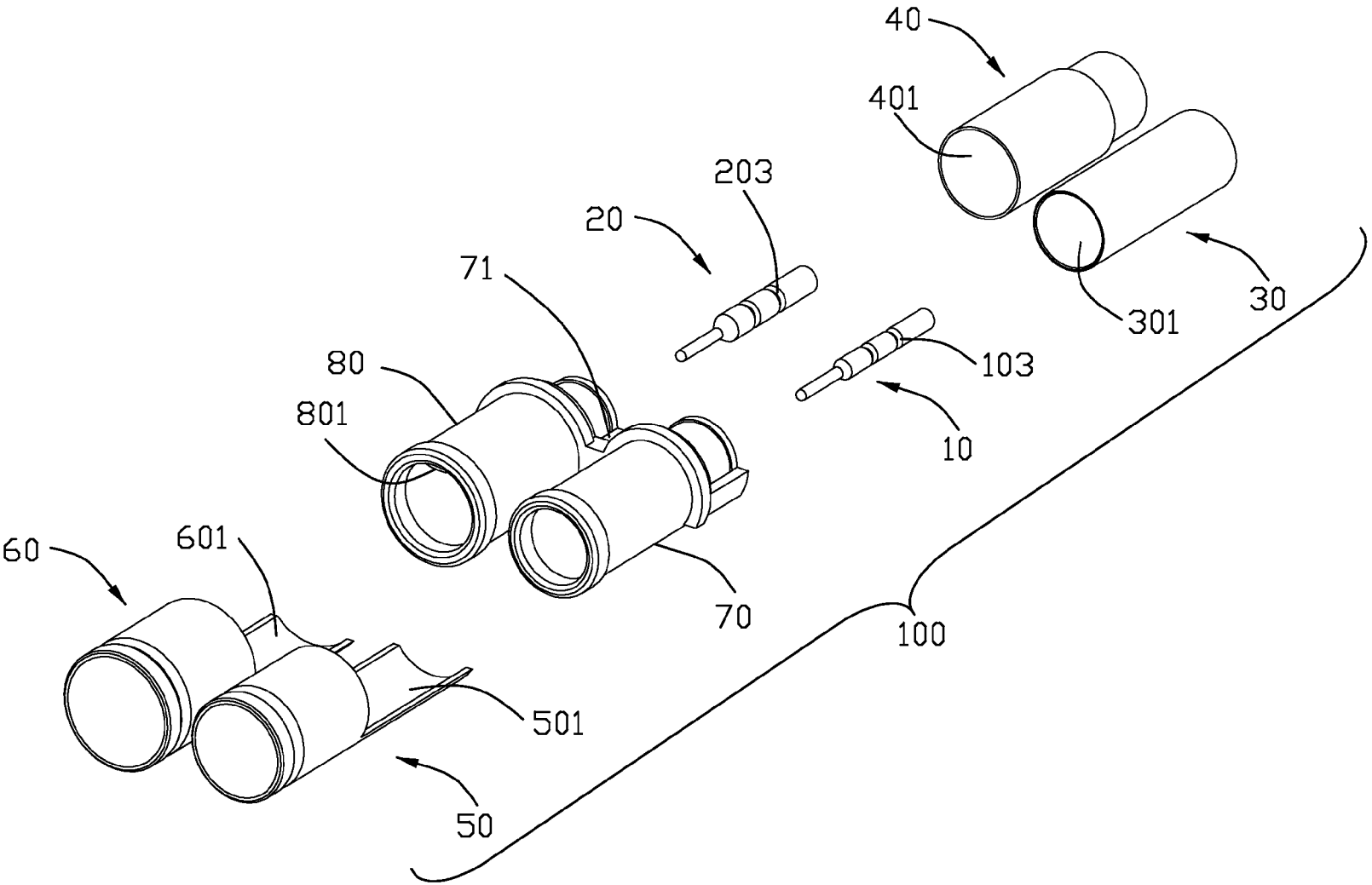
FIG. 1 is an exploded, perspective view of an electrical connector of the cable connector assembly.

Reference will now be made to the drawing figures to describe the present invention in detail.

Figure 2:
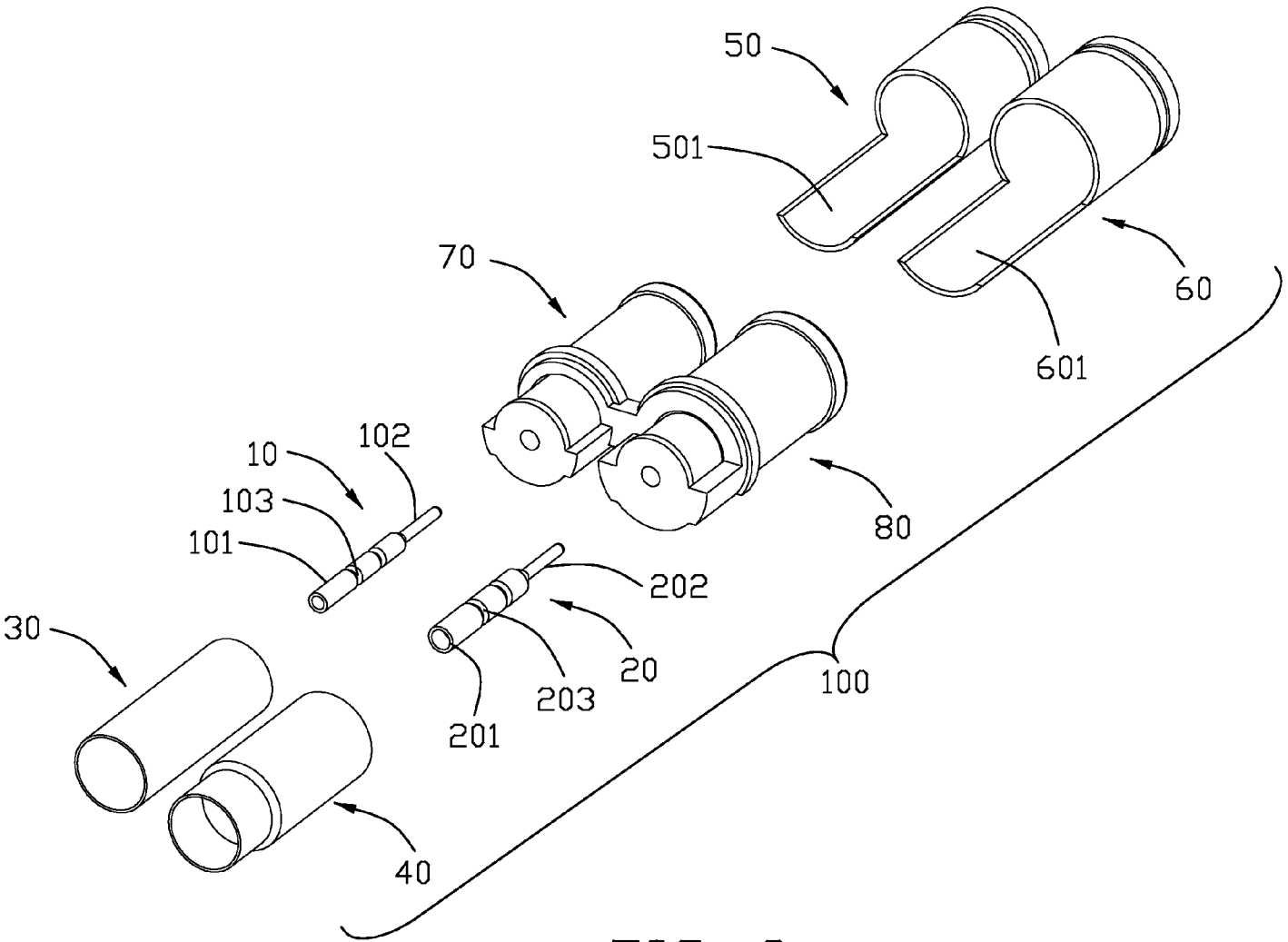
FIG. 2 is similar to FIG. 1, but viewed from another aspect.

Referring to FIGS. 1-2, a cable connector assembly 200 in accordance with the present invention comprises an electrical connector 100, a cable 91 including a plurality of wires and an insulative cover 92 over-molded on an electrical connection area between the electrical connector 100 and the cable 91. The electrical connector 100 comprises a first connector 1 and a second connector 2, the first connector 1 has a contact 10, a middle tube 30, an outer tube 50 and a first insulated housing 70, and the second connector 2 has a contact 20, a middle tube 40, an outer tube 60 and a second insulated housing 80.

Figure 3:
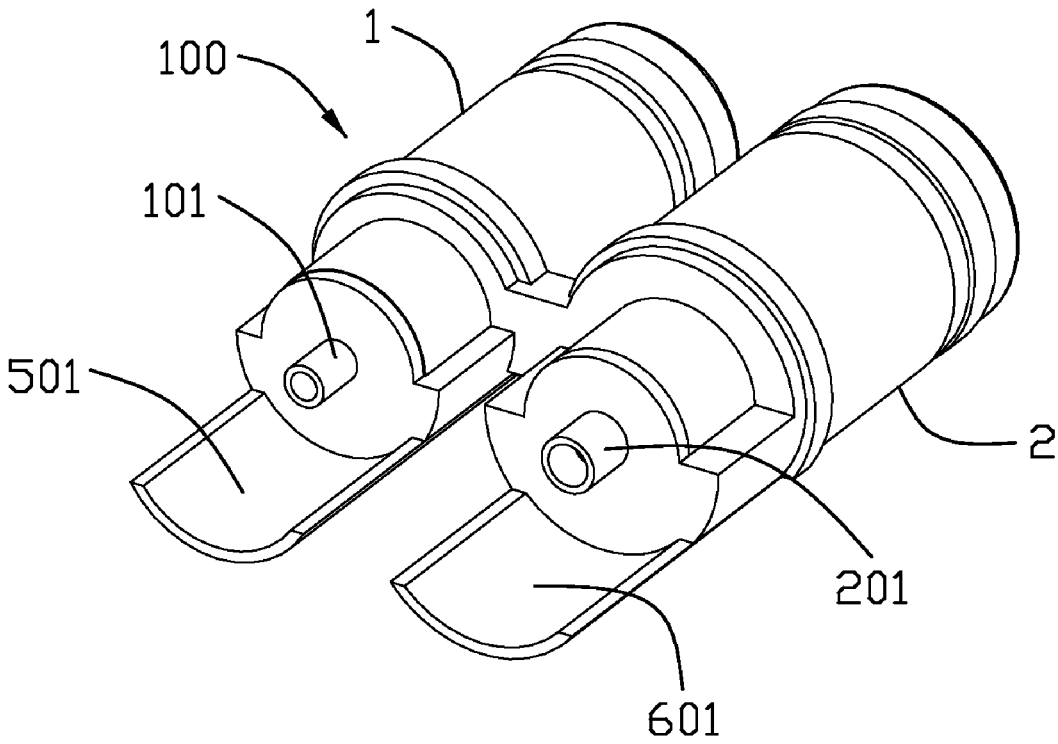
FIG. 3 is an assembled, perspective view of the electrical connector shown in FIG. 2.

Referring to FIGS. 1-3, the contact 10 is used for transmitting signal, and the contact 20 is used for transmitting power, the signal contact 10 and the power contact 20 are made of conductive material, and the power contact 20 has a larger diameter than the signal contact 10. The signal contact 10 comprises a connecting portion 101 in a back end and a contacting portion 102 in a front end, the power contact 20 comprises a connecting portion 201 in a back end and a contacting portion 202 in a front end, and the connecting portions 101, 201 are larger than the corresponding contacting portions 102, 202 in diameter. The signal contact 10 and the power contact 20 also have a plurality of grooves 103, 203 in exterior surface thereof respectively to enhance the combinations between the contacts 10, 20 with the insulated housings 70, 80.

The middle tubes 30, 40 are made of conductive material, and named as the first middle tube 30 and the second middle tube 40. The second middle tube 40 has a larger front segment and a smaller back segment to form a step portion therebetween.

The outer tubes 50, 60 are also made of conductive material, and extend backwards to form arc-shaped joining portions 501, 601 receiving solder. The first and second middle tubes 30, 40 are enclosing the signal contact 10 and the power contact 20 respectively, the outer tubes 50, 60 are enclosing and spaced from the first and the second middle tubes 30, 40, the insulated housing 70 is filled in a spaced area between the outer tube 50 and the first middle tube 30, and the insulated housing 80 is filled in a spaced area between the outer tube 60 and the second middle tube 40. The insulated housings 70, 80 are unitarily molded with each other, and connected with each other by a linking portion 71. A tab 801 is defined in a cavity of the insulated housing 80 to prevent the contacting portions 102, 202 from mismating with a complementary connector (not shown).

Figure 4:
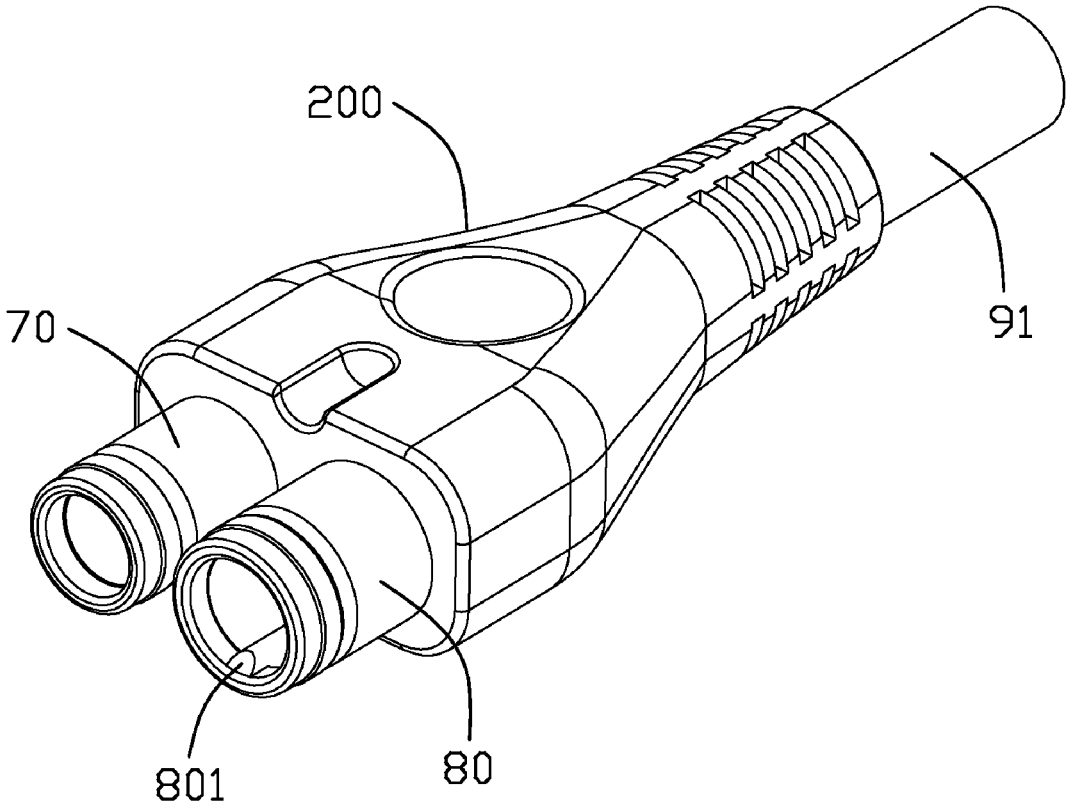
FIG. 4 is an assembled, perspective view of the cable connector assembly.
Figure 5:
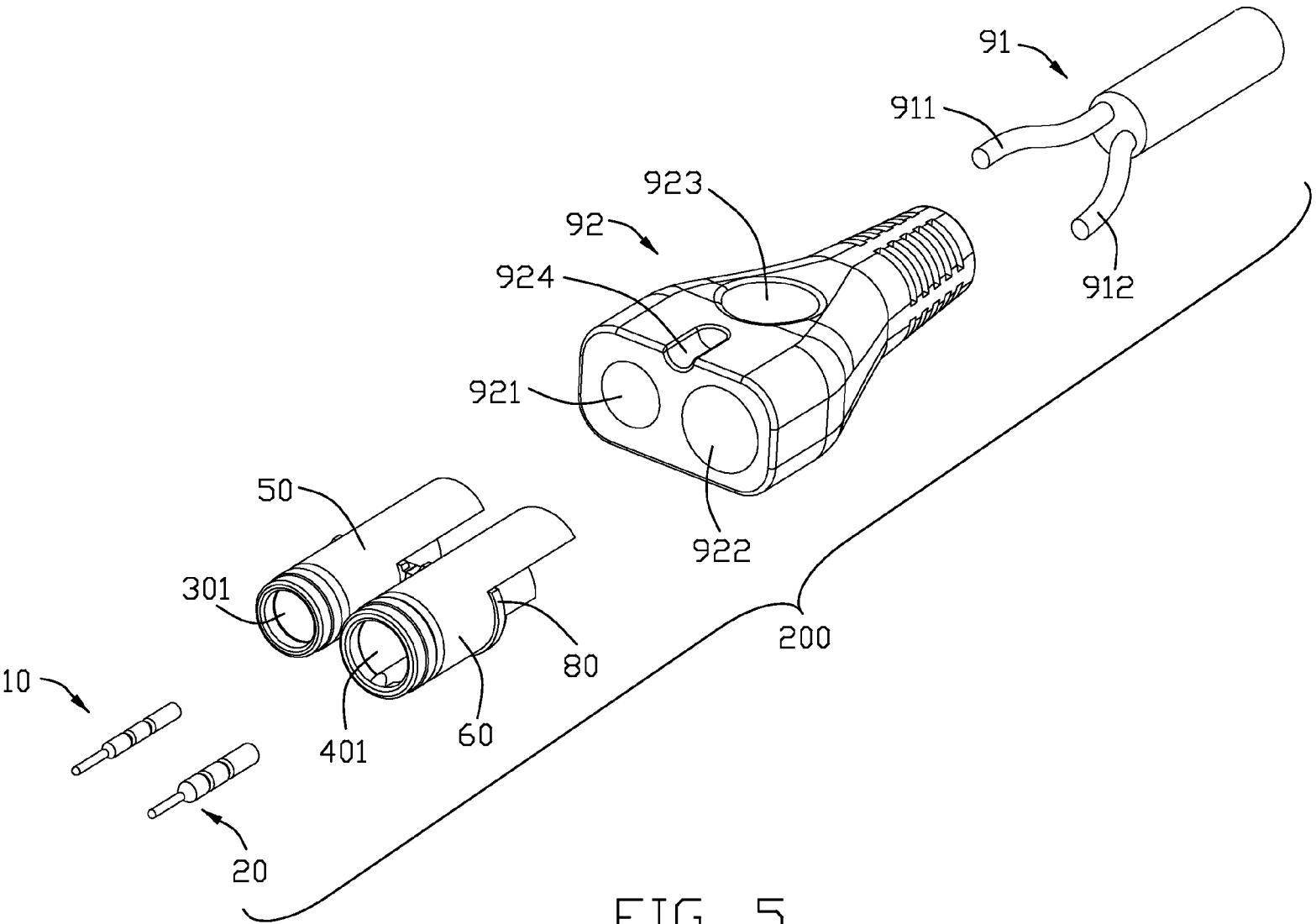
FIG. 5 is a partially assembled view of the cable connector assembly.
Figure 6:
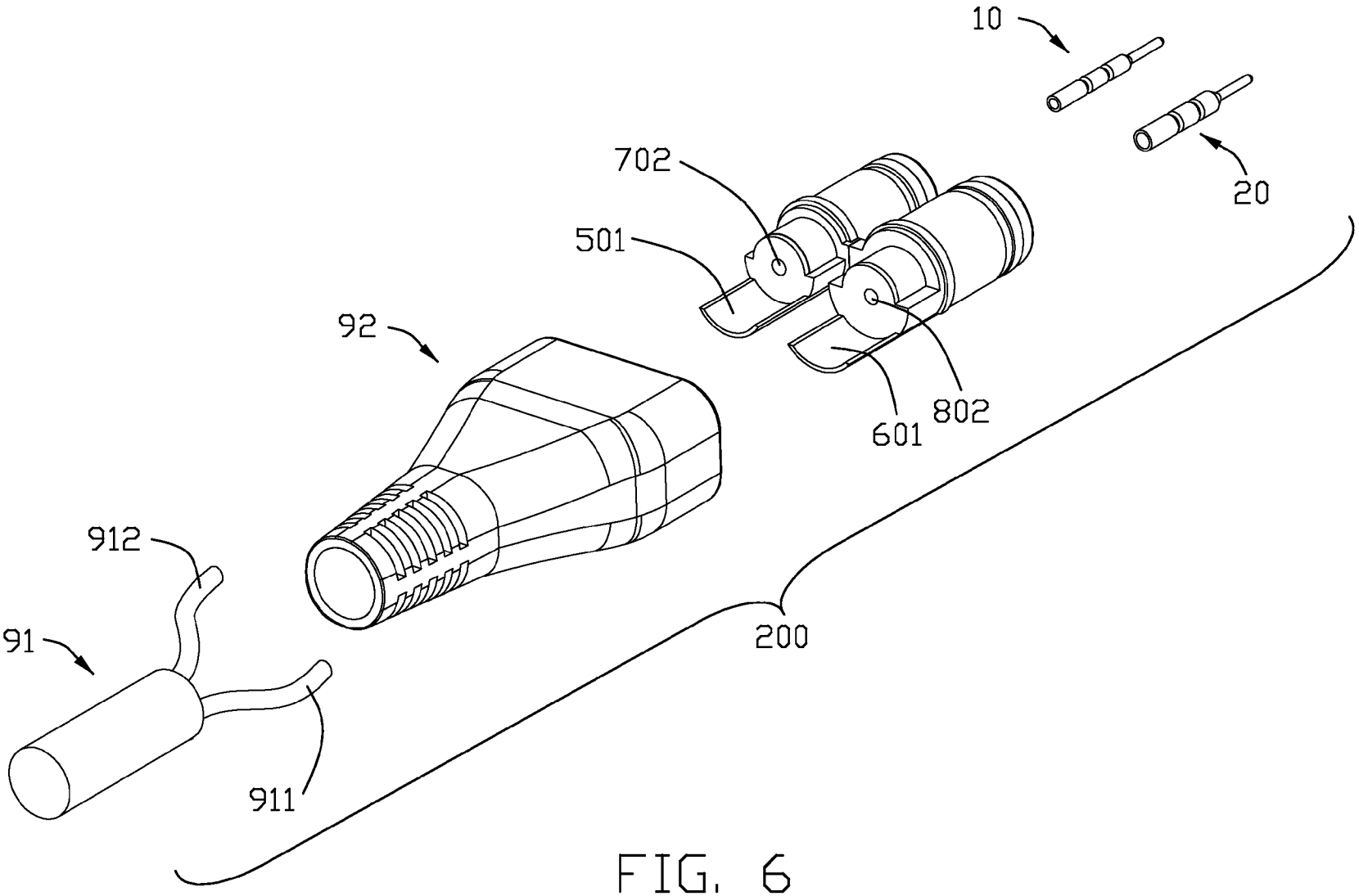
FIG. 6 is similar to FIG. 5, but viewed from another aspect.

Referring to FIGS. 4-6, the middle tubes 30, 40 define receiving spaces 301, 401 respectively, the contacting portions 102, 202 of the contacts 10, 20 are inserted into the insulated housings 70, 80 and accommodated in the receiving spaces 301, 401. The connecting portions 101, 201 extend beyond the insulated housing 70, 80 to be soldered with the cable 91.

The cable 91 comprises a pair of wires 51, 52 connected with the first connector 1 and the second connector 2 respectively, and each wire comprises three conductors (not shown)

electrically connecting with the contact 10, 20, the middle tube 30, 40 and the outer tube 50, 60.

The insulative cover 92 is over-molded on the electrical connection between the electrical connector 100 and the cable 91. The insulative cover 92 defines a first receiving channel 921 and a second receiving channel 922 recessed from front to back, the first connector 1 and the second connector 2 are enclosed in the first receiving channel 921 and the second receiving channel 922. A circular pressing portion 923 is recessed downwards from a bottom surface of the insulative cover 92, an indentation 924 is defined in a front end of the insulative cover 92 and recessed downwards from the bottom surface of the insulative cover 92, to prevent the cable connector assembly 200 from mismating with the complementary connector. The indentation 924 is located in front of the pressing portion 923.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an electrical connector including a first connector and a second connector, each of the first connector and the second connector having a contact, a middle tube enclosing the contact and an outer tube enclosing the middle tube, a first insulated housing defined between the outer tube and the middle tube of the first connector, and a second insulated housing defined between the outer tube and the middle tube of the second connector, the first insulated housing unitarily molded with the second insulated housing;

a cable connected with the electrical connector; and an insulated cover over-molded on an electrical connection area between the electrical connector and the cable, and comprising a pair of receiving channels.

2. The cable connector assembly as claimed in claim 1, wherein the first insulated housing is connected with the second insulated housing by a linking portion.

3. The cable connector assembly as claimed in claim 1, wherein the outer tube extends backwards to form an arc-shaped joining portion.

4. The cable connector assembly as claimed in claim 1, wherein the first connector and the second connector are accommodated in the corresponding receiving channels.

5. The cable connector assembly as claimed in claim 4, wherein the second insulated housing defines a tab in a cavity thereof to be distinguished from the first insulated housing.

6. The cable connector assembly as claimed in claim 1, wherein the middle tube of the second connector has a larger front segment and a smaller back segment to form a step portion.

7. The cable connector assembly as claimed in claim 1, wherein the contact of the first connector is used for transmitting signal, and the contact of the second connector is used for transmitting power.

8. The cable connector assembly as claimed in claim 7, wherein the contacts have a plurality of grooves engaging with the corresponding insulated housing.

9. The cable connector assembly as claimed in claim 1, wherein the insulative cover comprises a pressing portion and an indentation recessed downwards from a bottom face thereof, the indentation located in front of the pressing portion.

10. The cable connector assembly as claimed in claim 9, wherein the pressing portion is of round shape, and recessed downwards from a middle portion of the bottom face of the insulated cover.

11. The cable connector assembly as claimed in claim 10, wherein the indentation is of arc-shaped along a cross-section.

* * * * *